US006326868B1

(12) United States Patent
Kranz et al.

(10) Patent No.: US 6,326,868 B1
(45) Date of Patent: Dec. 4, 2001

(54) ROTARY CONTACT ASSEMBLY FOR HIGH AMPERE-RATED CIRCUIT BREAKER

(75) Inventors: Stefan Kranz, Eutin (DD); Francesco DeVizzi, Milan (IT); Rolf-Dieter Bauer, Rastorf (DD)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/108,684

(22) Filed: Jul. 1, 1998

(30) Foreign Application Priority Data

Jul. 2, 1997 (IT) ..... MI97A1564

(51) Int. Cl.[7] ..... H01H 75/00
(52) U.S. Cl. ..... 335/8; 335/16; 218/22
(58) Field of Search ..... 335/8–10, 16, 335/147, 195; 218/22, 152–4

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jeneks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |
| 4,263,492 | 4/1981 | Maier et al. . |
| 4,276,527 | 6/1981 | Gerbert-Gaillard et al. . |

(List continued on next page.)

FOREIGN PATENT DOCUMENTS

| | | |
|---|---|---|
| 819 008 A | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 0940 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

A circuit breaker rotary contact arm is used within a plurality of single pole circuit breakers ganged together to form a single multi-pole circuit breaker. To provide uniform contact wear among the associated circuit breaker contacts, the rotor carrying the rotary contact arm pivot is slotted to automatically position the rotary contact arm to allow for changes in the contact geometry while maintaining constant contact compressive forces. The individual circuit breakers connect with the central operation mechanism by means of a single pin.

26 Claims, 6 Drawing Sheets

U.S. PATENT DOCUMENTS 4,297,663 10/1981 Seymour et al. .
4,301,342 11/1981 Castonguay et al. .
4,360,852 11/1982 Gilmore .
4,368,444 1/1983 Preuss et al. .
4,375,021 2/1983 Pardini et al. .
4,375,022 2/1983 Daussin et al. .
4,376,270 3/1983 Staffen .
4,383,146 5/1983 Bur .
4,392,036 7/1983 Troebel et al. .
4,393,283 7/1983 Masuda .
4,401,872 8/1983 Boichot-Castagne et al. .
4,409,573 10/1983 DiMarco et al. .
4,435,690 3/1984 Link et al. .
4,467,297 8/1984 Boichot-Castagne et al. .
4,468,645 8/1984 Gerbert-Gailard et al. .
4,470,027 9/1984 Link et al. .
4,479,143 10/1984 Watanabe et al. .
4,488,133 12/1984 McClellan et al. .
4,492,941 1/1985 Nagel .
4,541,032 9/1985 Schwab .
4,546,224 10/1985 Mostosi .
4,550,360 10/1985 Dougherty .
4,562,419 12/1985 Preuss et al. .
4,589,052 5/1986 Dougherty .
4,595,812 6/1986 Tamaru et al. .
4,611,187 9/1986 Banfi .
4,612,430 9/1986 Sloan et al. .
4,616,198 10/1986 Pardini .
4,622,444 11/1986 Kandatsu et al. .
4,631,625 12/1986 Alexander et al. .
4,642,431 2/1987 Tedesco et al. .
4,644,438 2/1987 Puccinelli et al. .
4,649,247 3/1987 Preuss et al. .
4,658,322 4/1987 Rivera .
4,672,501 6/1987 Bilac et al. .
4,675,481 6/1987 Markowski et al. .
4,682,264 7/1987 Demeyer .
4,689,712 8/1987 Demeyer .
4,694,373 9/1987 Demeyer .
4,710,845 12/1987 Demeyer .
4,717,985 1/1988 Demeyer .
4,733,211 3/1988 Castonguay et al. .
4,733,321 3/1988 Lindeperg .
4,764,650 8/1988 Bur et al. .
4,768,007 8/1988 Mertz et al. .
4,780,786 10/1988 Weynachter et al. .
4,831,221 5/1989 Yu et al. .
4,870,531 9/1989 Danek .
4,883,931 11/1989 Batteux et al. .
4,884,047 11/1989 Baginski et al. .
4,884,164 11/1989 Dziura et al. .
4,900,882 2/1990 Bernard et al. .
4,910,485 3/1990 Bolongeat-Mobleu et al. .
4,914,541 4/1990 Tripodi et al. .
4,916,420 4/1990 Bartolo et al. .
4,916,421 4/1990 Pardini et al. .
4,926,282 5/1990 McGhie .
4,935,590 6/1990 Malkin et al. .
4,937,706 6/1990 Schueller et al. .
4,939,492 7/1990 Raso et al. .
4,943,691 7/1990 Mertz et al. .
4,943,888 7/1990 Jacob et al. .
4,950,855 8/1990 Bolonegeat-Mobleu et al. .
4,951,019 8/1990 Gula .
4,952,897 8/1990 Barnel et al. .
4,958,135 9/1990 Baginski et al. .
4,965,543 10/1990 Batteux .
4,983,788 1/1991 Pardini .
5,001,313 3/1991 Leclerq et al. .
5,004,878 4/1991 Seymour et al. .
5,029,301 7/1991 Nebon et al. .
5,030,804 7/1991 Abri .
5,057,655 10/1991 Kersusan et al. .
5,077,627 12/1991 Fraisse .
5,083,081 1/1992 Barrault et al. .
5,095,183 3/1992 Raphard et al. .
5,103,198 4/1992 Morel et al. .
5,115,371 5/1992 Tripodi .
5,120,921 6/1992 DiMarco et al. .
5,132,865 7/1992 Mertz et al. .
5,138,121 8/1992 Streich et al. .
5,140,115 8/1992 Morris .
5,153,802 10/1992 Mertz et al. .
5,155,315 10/1992 Malkin et al. .
5,166,483 11/1992 Kersusan et al. .
5,172,087 12/1992 Castonguay et al. .
5,178,504 1/1993 Falchi .
5,184,717 2/1993 Chou et al. .
5,187,339 2/1993 Lissandrin .
5,198,956 3/1993 Dvorak .
5,200,724 4/1993 Gula et al. .
5,210,385 5/1993 Morel et al. .
5,239,150 8/1993 Bolongeat-Mobleau et al. .
5,260,533 11/1993 Livesey et al. .
5,262,744 11/1993 Arnold et al. .
5,280,144 1/1994 Bologeat-Mobleu et al. .
5,281,776 1/1994 Morel et al. .
5,296,660 3/1994 Morel et al. .
5,296,664 3/1994 Crookston et al. .
5,298,874 3/1994 Morel et al. .
5,300,907 4/1994 Nereau et al. .
5,310,971 5/1994 Vial et al. .
5,313,180 5/1994 Vial et al. .
5,317,471 5/1994 Izoard et al. .
5,331,500 7/1994 Corcoles et al. .
5,334,808 8/1994 Bur et al. .
5,341,191 8/1994 Crookston et al. .
5,347,096 9/1994 Bologneat-Mobleu et al. .
5,347,097 9/1994 Bolongeat-Mobleu et al. .
5,350,892 9/1994 Rozier .
5,357,066 10/1994 Morel et al. .
5,357,068 10/1994 Rozier .
5,357,394 10/1994 Piney .
5,361,052 11/1994 Ferullo et al. .
5,373,130 12/1994 Barrault et al. .
5,379,013 1/1995 Coudert .
5,424,701 6/1995 Castonguary et al. .
5,438,176 8/1995 Bonnardel et al. .
5,440,088 8/1995 Coudert et al. .
5,449,871 9/1995 Batteux et al. .
5,450,048 9/1995 Leger et al. .
5,451,729 9/1995 Onderka et al. .
5,457,295 10/1995 Tanibe et al. .
5,467,069 11/1995 Payet-Burtin et al. .
5,469,121 11/1995 Payet-Burin .
5,475,558 12/1995 Barjonnet et al. .
5,477,016 12/1995 Baginski et al. .
5,479,143 12/1995 Payet-Burin .
5,483,212 1/1996 Lankuttis et al. .
5,485,343 1/1996 Santos et al. .
5,493,083 2/1996 Olivier .
5,504,284 4/1996 Lazareth et al. .
5,504,290 4/1996 Baginski et al. .
5,510,761 4/1996 Boder et al. .
5,512,720 4/1996 Coudert et al. .
5,515,018 5/1996 DiMarco et al. .
5,519,561 5/1996 Mrenna et al. .
5,534,674 7/1996 Steffens .
5,534,832 7/1996 Duchemin et al. .
5,534,835 7/1996 McColloch et al. .
5,534,840 7/1996 Cuingnet .

| | | |
|---|---|---|
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

CONTACTS CLOSED

BLOWN OPEN

LOCKED OPEN

OPEN

ROTARY CONTACT ASSEMBLY FOR HIGH AMPERE-RATED CIRCUIT BREAKER

BACKGROUND OF THE INVENTION

U.S. Pat. No. 4,616,198 entitled "Contact Arrangement for a Current Limiting Circuit Breaker" describes the early use of a first and second pair of circuit breaker contacts arranged in series to substantially reduce the amount of current let-through upon the occurrence of an overcurrent condition.

When the contact pairs are arranged upon one movable rotary contact arm, such as described within U.S. Pat. No. 4,910,485 entitled "Multiple Circuit Breaker with Double Break Rotary Contact", some means must be provided to insure that the opposing contact pairs exhibit the same contact pressure to reduce contact wear and erosion.

One arrangement for providing uniform contact wear is described within U.S. Pat. No. 4,649,247 entitled "Contact Assembly for Low-voltage Circuit Breakers with a Two-Arm Contact Lever". This arrangement includes an elongated slot formed perpendicular to the contact travel to provide uniform contact closure force on both pairs of contacts.

U.S. Pat. No. 5,030,804 entitled "Contact Arrangement for Electrical Switching Devices" describes providing a pair of cylindrical plates on either side of the rotary contact arms and forming elongated slots within each of the cylindrical plates.

When the rotary contacts are used within a range of differing ampere-rated circuit breakers, the size of the contact arms varies in accordance with the ampere rating such that the accompanying cylindrical plates must be sized accordingly.

It would be economically advantageous to have a wide range of rotary contact circuit breakers having provision for reducing contact wear without having to stock and assemble a wide range of slotted cylindrical plates.

Accordingly, one purpose of the invention is to include means for reducing such contact wear in rotary contact circuit breakers over a wide range of ampere ratings with the smallest number of associated contact assembly components.

SUMMARY OF THE INVENTION

A circuit breaker rotary contact arm is used within a plurality of single pole circuit breakers ganged together to form a single multi-pole circuit breaker. To provide uniform contact wear among the associated circuit breaker contacts, the rotor carrying the rotary contact arm pivot is slotted to allow the contact arm to provide constant contact compressive forces. The central section of the contact arm is configured to position the contacts within defined CLOSED, BLOW OPEN and LOCK OPEN positions. Interconnection of the rotor assemblies with the operating mechanism is achieved by a single elongated pin.

DESCRIPTION OF THE PREFERRED EMBODIMENT

Figure 1:
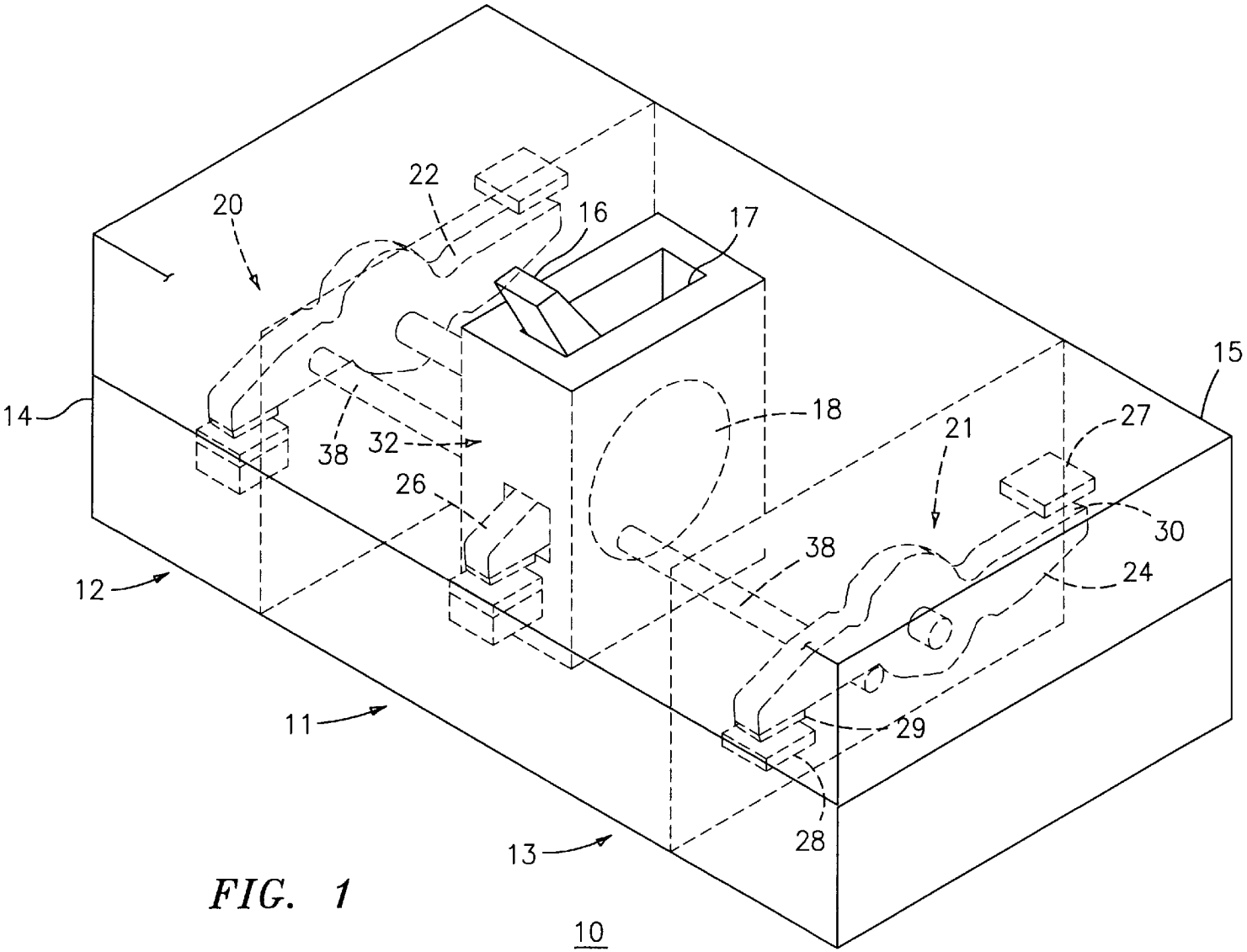
FIG. 1 is a top perspective view of a multi-pole circuit breaker consisting of three single pole assemblies contained within a single circuit breaker housing.

A multi-pole circuit breaker 10 is shown in FIG. 1 consisting of a case 14 and cover 15 with an operating handle 16 projecting from the cover through an aperture 17. The operating handle interacts with the circuit breaker operating mechanism 18 to control the ON and OFF positions of the central rotary contact arm 26, and central rotary contact arm assembly 32 within the circuit breaker operating mechanism. A first rotary contact arm 22 and first rotary contact arm assembly 20 within a first pole 12, on one side of the operating mechanism 18, and a second rotary contact arm 24 and second rotary contact arm assembly 21 within a second pole 13, on the opposite side of the operating mechanism move in unison to provide complete multi-pole circuit interruption. An elongated pin 38 interconnects the operating mechanism 18 with the first and second rotary contact arm assemblies 20, 21. As described within the aforementioned U.S. Pat. No. 4,649,247, a rotor 25 interconnects each of the rotary contact arms 22, 24 with the corresponding pairs of fixed contacts 27, 28 and movable contacts 29, 30.

Figure 2:
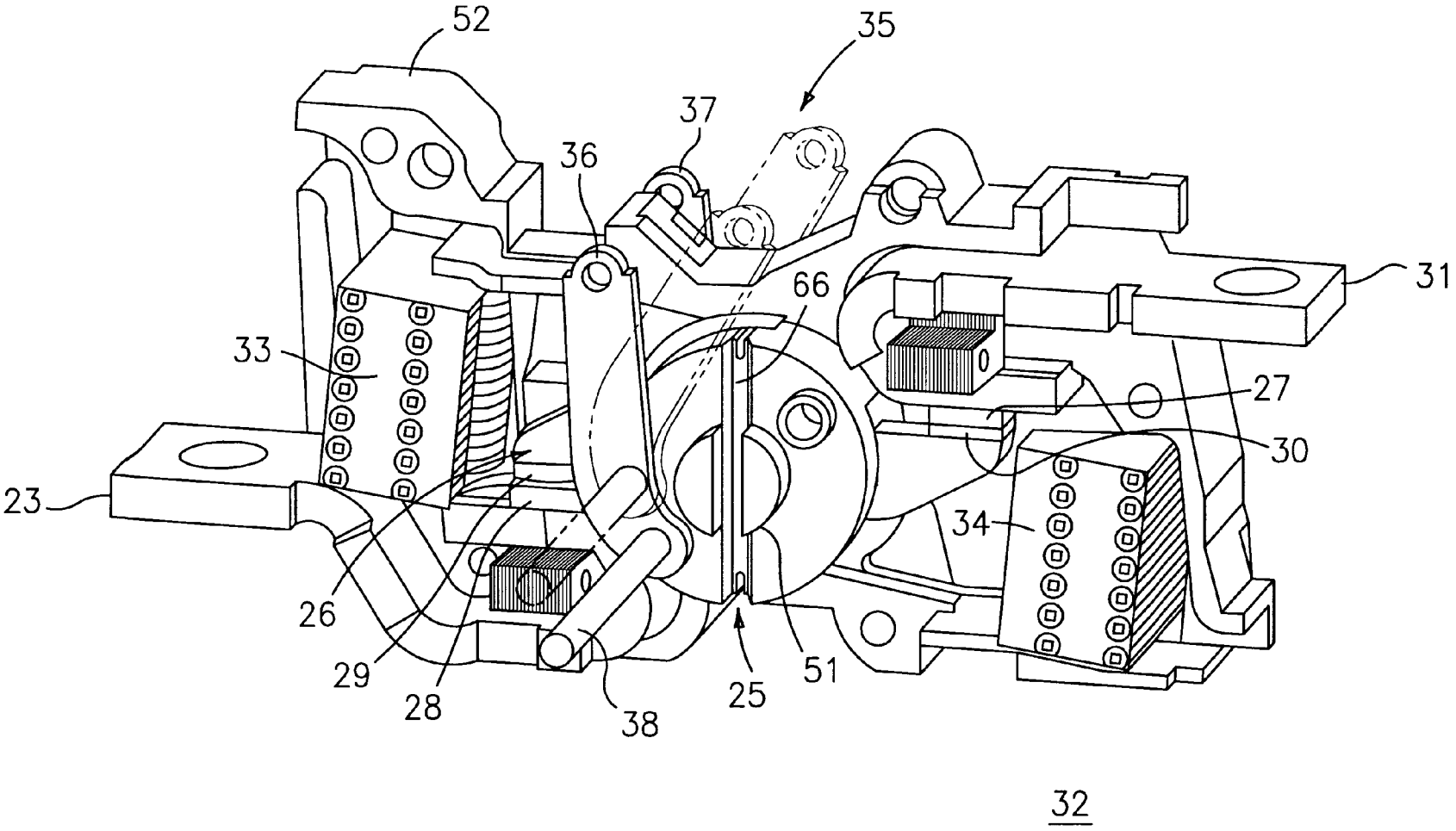
FIG. 2 is an enlarged side view of one of the single pole assemblies within the circuit breaker of FIG. 1.

In accordance with the invention, the central rotary contact arm assembly 32 is depicted in FIG. 2 to show the positional arrangement between the rotor 25 intermediate a lower or load strap 23 and an upper or line strap 31 and the associated arc chutes 33, 34. The first rotary contact arm assembly 20 and second rotary contact arm assembly 21 of FIG. 1 are not shown herein but are mirror image of the central rotary contact arm assembly 32 and operate in a similar manner. The arc chutes 33, 34 are similar to that described within U.S. Pat. No. 4,375,021 entitled "Rapid Electric Arc Extinguishing Assembly in Circuit-Breaking Devices Such as Electric Circuit Breakers". The central rotary contact arm 26 moves in unison with the rotor 25 that, in turn, connects with the circuit breaker operating mechanism by means of the elongated pin 38 to movable contacts 29, 30 from fixed contacts 27,28. The clevis 35 consisting of the extending sidearms 36, 37 attach the rotor 25 with the circuit breaker operating mechanism 18 and the operating handle 16 of FIG. 1 to allow both automatic as well as manual intervention for opening and closing the circuit breaker contacts 27–30. The rotor 25 is supported within the side walls 52 by means of trunnion 51.

Figure 3:
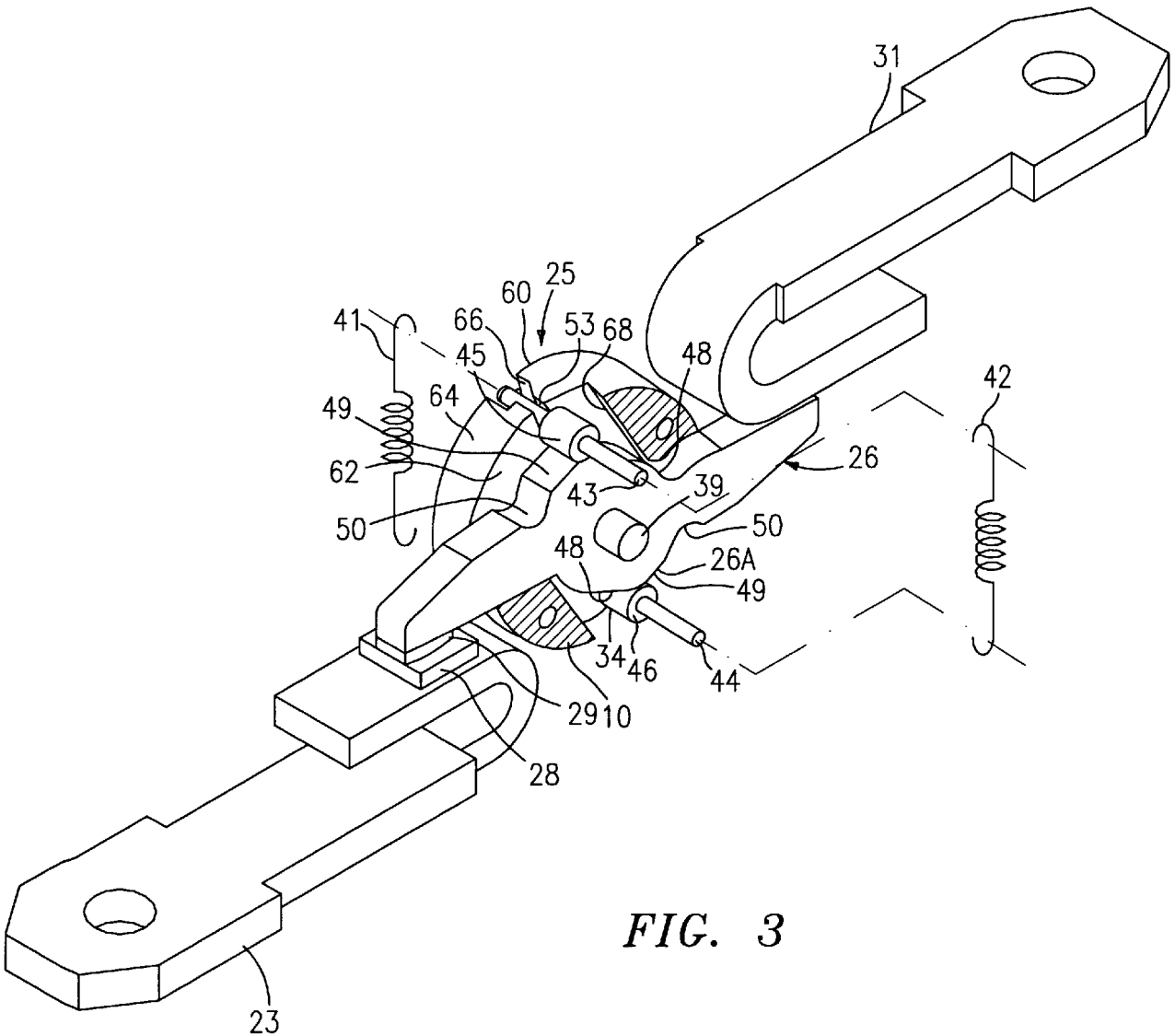
FIG. 3 is a top perspective view of the contact arrangement within the single pole assembly of FIG. 2.

FIG. 3 shows a cross sectional view of rotor 25. The half of rotor 25 shown in FIG. 3 includes an outer face 60, an inner face 62, and a perimeter 64. Outer face 60 includes a groove 66 disposed thereon. Groove 66 has a length equal to the diameter of rotor 25 and a depth that is less than the distance between the inner and outer faces 62, 60. Inner face 62 includes protrusions 68, 70 extending therefrom and positioned along the periphery of rotor 25.

Perimeter 64 includes diametrically opposed slots 53, 54, which extend from said groove to said inner face and from perimeter toward the axis of rotor 25. Slot 53 accepts one end of a pin 43. Slot 54 accepts one end of a pin 44. Pins 43, 44 extend from slots 53, 54, respectively, to corresponding slots in the half of rotor 25 not shown. Slots 53, 54, and the corresponding slots on the half of rotor 25 not shown, are sized to prevent the translational movement of pins 43, 44 in all directions but the radial direction with respect to rotor 25. Pins 43, 44 include rollers 45, 46, respectively, disposed along a center length thereof. Groove 64 accepts an extension spring 41 that extends from pin 43 to pin 44. Similarly, an extension spring 42 extends from pin 43 to pin 44 and is positioned on the opposite side of rotor 25.

FIG. 3 also shows rotary contact arm 26 positioned between protrusions 68, 70 of rotor 25 and between the line and load straps 23, 31. Rotary contact arm 26 includes a central region 26A, with the upper and lower portions of central region forming camming surfaces 48, 49, 50. Rotary contact arm 26 further includes a pivot pin 39, which extends from both sides of central region 26A.

Pins 43, 44 extend across the top and bottom of central region 26A, respectively. Rollers 45, 46 are urged onto camming surfaces 48, 49, 50 of central region 26A by the force of springs 41, 42, which act to draw pins 43, 44, and their rollers 45, 46, towards each other. Rollers 45, 46 prevent uneven wear of camming surfaces 48, 49, 50. The positional relationship between rollers 45, 46 and the central region 26A of rotor 26 to avoid uneven wear is an important feature of the invention and will be described below with reference to FIGS. 5A–5D.

Figure 4:
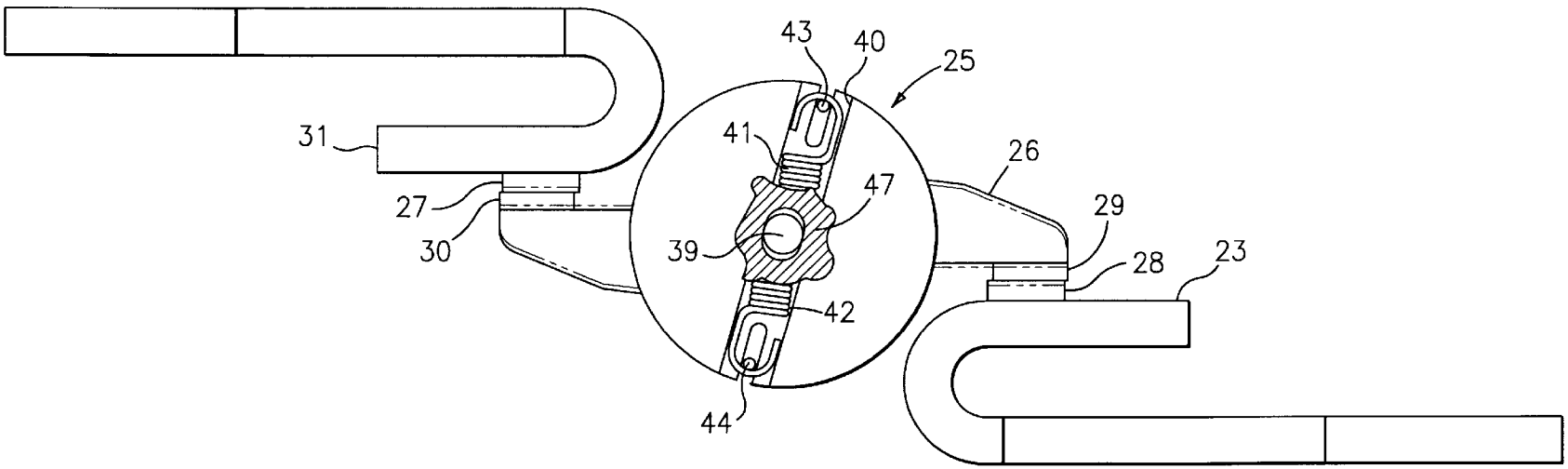
FIG. 4 is a side plan view of the rotor used with the contact arrangement of FIG. 2.

The rotor 25 is shown in FIG. 4 relative to the line strap 23 and load strap 31, central rotary contact arm 26 and contacts 27–30 to help describe the manner in which the fixed contacts 27, 28 remain in close abutment with the movable contacts 29, 30 in counter-relation to contact erosion and wear. As shown earlier, a pair of extension springs, one of which is shown at 42, extend between opposing top and bottom pins 43, 44 that are positioned within slots 53,54 in the rotor 25. An elongated slot 47 is disposed in rotor 25. Elongated slot 47 accepts pivot pin 39 pivotally secure the rotary contact arm 26 within the rotor 25. Slot 47 is elongated in a direction parallel to springs 41 and 42. Because aperture 47 is elongated, the rotary contact arm 26 can move in the direction of the elongation. The "floating" relationship between the operating pivot pin 39 and the contact closing springs 41, 42 allows the springs to force the movable contacts 29, 30 into tight abutment with the associated fixed contacts 27, 28 as indicated in phantom to compensate for contact wear and erosion.

Figure 5A:
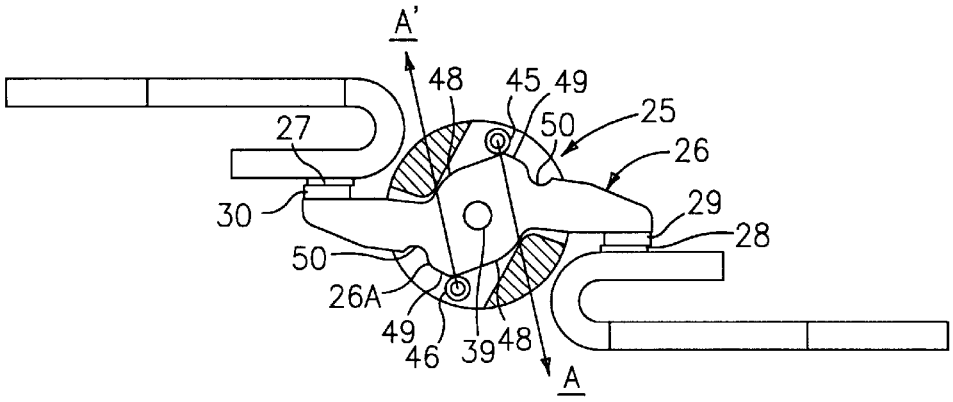
FIG. 5A is a side plan view of the single pole assembly of FIG. 2 depicting the contact arm in the CONTACTS CLOSED position.
Figure 5B:
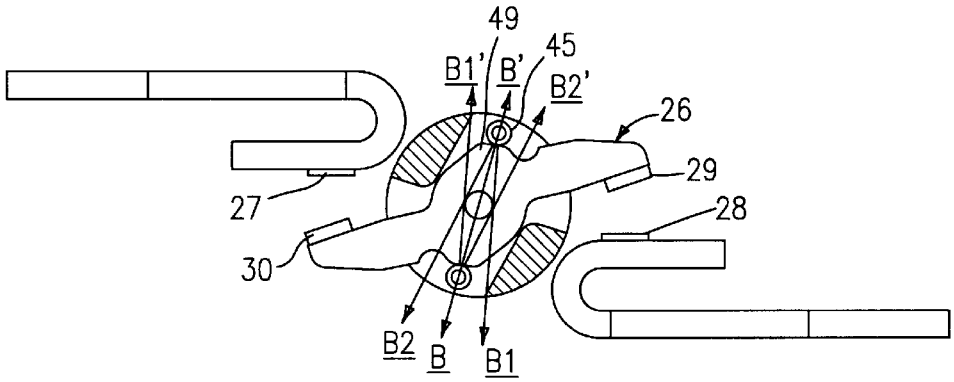
FIG. 5B is a side plan view of the single pole assembly of FIG. 2 depicting the contact arm in the BLOWN OPEN position under intense overcurrent condition (short circuit current)
Figure 5C:
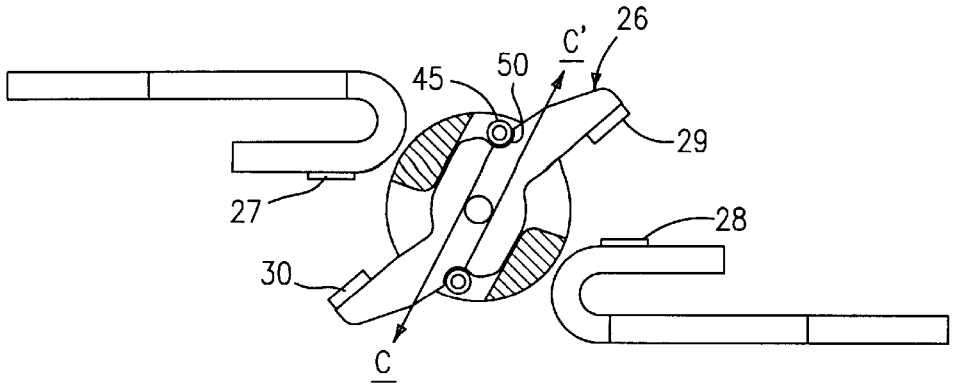
FIG. 5C is a side plan view of the single pole assembly of FIG. 2 depicting the contact arm in the LOCKED OPEN position.
Figure 5D:
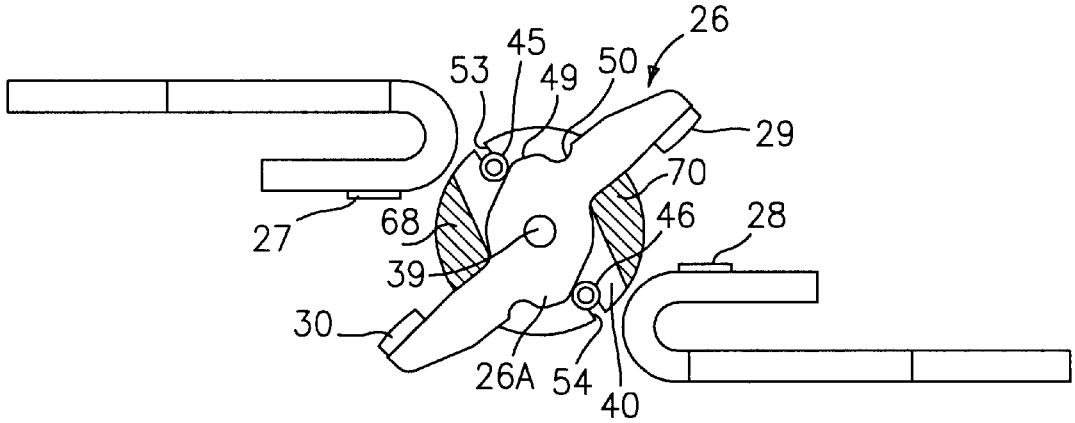
FIG. 5D is a side plan view of the single pole assembly of FIG. 2 depicting the contact arm the OPEN position due to the intervention of tripping devices associated to the circuit breaker.

The enhanced contact separation and control provided by the rotor 25 is best seen by now referring to FIGS. 5A–5D rotary contact arm 26 and contact pairs 27 and 30, 28 and 29 move from the CONTACTS CLOSED, to BLOWN OPEN, to LOCKED OPEN and OPEN positions indicated therein. As previously described, the central region 26A of rotary contact arm 26 includes camming surfaces 48, 49, 50. Rollers 45, 46 are urged onto camming surfaces 48, 49, 50 by the force of springs 41, 42, which act to draw the two rollers 45, 46 towards each other. Rollers 45, 46 transmit the force of springs 41, 42 to camming surfaces 48, 49, 50 in a direction normal to the surfaces. Camming surfaces 48, 49, 50, are shaped to affect the direction of this force. In the CONTACTS CLOSED condition indicated in FIG. 5A, the lines of force created by springs 41, 42 and through rollers 45, 46 to camming surfaces 48 are indicated by the arrows A and A'. In the CONTACTS CLOSED condition, the forces in the directions A and A' create a moment about pivot 39 that rotates contact arm 26 in the clockwise direction and forces contact pairs 27 and 30, 28 and 29 together. In the BLOWN OPEN condition, when the central rotary contact arm 26 is magnetically "blown" in the counter-clockwise direction under intense overcurrent conditions, the rollers are positioned on the second camming surfaces 49 formed on the central region as indicated in FIG. 5B. During the BLOWN OPEN condition, the lines of force created by springs 41, 42 and through rollers 45, 46 to rotary contact arm 26 are indicated by the arrows B and B'. The lines of force B and B', which control the opening of the central rotary contact arm 26 under an intense overcurrent condition, is dictated by the shape of the second camming surfaces 49. Devices suited for selectivity will employ second camming surfaces 49 that produces lines of force B1 and B1'. Whereas, devices suited for rapid opening will employ second camming surfaces 49 that produces lines of force B2 and B2'. Upon complete contact separation, by further rotation of the rotary contact arm 26 in the counter-clockwise direction to the LOCKED OPEN condition shown in FIG. 5C, rollers 45, 46 become trapped within grooved camming surfaces 50 In the LOCKED OPEN condition, the lines of force created by springs 41, 42 and through rollers 45 and 46 to central rotary contact arm 26 are indicated by the arrows C and C' to prevent the central rotary contact arm 26 from rotating back to the CONTACTS CLOSED condition. FIG. 5D shows contact arm 26 in the OPEN position due to the intervention of tripping devices associated with the circuit breaker. Tripping of the circuit breaker operating mechanism causes the rotor 25 and the rollers 45, 46 to rotate in a counter-clockwise direction until the rollers 45, 46 engage the camming surfaces 48, and protrusions 68, 70 abut against rotary contact arm 26, placing the central rotary contact arm 26 in the OPEN condition. The central rotary contact arm 26 remains in the OPEN condition, depicted in FIG. 5D, until the operating handle 16, described earlier in FIG. 1, is first rotated to the contact opening to reset the operating mechanism, and then to contact closure, as viewed in FIG. 1, to reset the operating mechanism and return the rotary contact arm to the CLOSED condition shown in FIG. 5A.

A rotary contact arm assembly for circuit breaker having a wide range of ampere ratings has herein been described. Contact wear and erosion along with rotary contact arm control facility and mechanism interconnect means was illustrated by use of a limited number of components to reduce component cost as well as assembly time.

We claim:

1. A circuit breaker comprising:

first and second pairs of separable contacts, one of said first pair of separable contacts being arranged at one end of a first rotary contact arm and one of said second pair of separable contacts being arranged at an opposite end of said first rotary contact arm;

an operating mechanism interacting with said first rotary contact arm to rotate said first rotary contact arm for separating said one of said first pair of separable contacts from another of said first pair of separable contacts and said one of said second pair of separable contacts from another of said second pair of separable contacts; and a rotor connecting said first rotary contact arm with said operating mechanism, said rotor having an elongated slot disposed in a central region of said rotor and extending along a portion of a diameter of said rotor, and said first rotary contact arm having a first pivot pin extending from a central region of said first rotary contact arm, whereby said first pivot pin extends within said elongated slot for pivotally securing said first rotary contact arm to said rotor, said elongated slot allowing said first rotary contact arm to translate relative to said rotor in a direction parallel to said diameter.

2. The circuit breaker of claim 1 including third and fourth pairs of separable contacts one of said third pair of contacts being arranged at one end of a second rotary contact arm and one of said fourth pair of contacts being arranged at an opposite end thereof.

3. The circuit breaker of claim 2 including fifth and sixth pairs of separable contacts one of said fourth pair of contacts being arranged at one end of a third rotary contact arm and one of said fifth pair of contacts being arranged at an opposite end thereof.

4. The circuit breaker of claim 1 wherein said first rotary contact arm further includes a first camming surface perimetric said central region, said first camming surface for accepting a roller, said roller imparting a force on said first camming surface for holding said first rotary contact arm in a contacts closed position.

5. The circuit breaker of claim 4 wherein said first rotary contact arm further includes a second camming surface perimetric said central region, said second camming surface for accepting said roller, said roller imparting a force on said second camming surface for controlling the transition of said first rotary contact arm to a blown open position.

6. The circuit breaker of claim 5 wherein said force acts in a direction through an axis of rotation of said first contact arm.

7. The circuit breaker of claim 5 wherein said force acts in a direction to bias said first contact arm in clockwise direction.

8. The circuit breaker of claim 5 wherein said force acts in a direction to bias said first contact arm in counter-clockwise direction.

9. The circuit breaker of claim 4 wherein said first rotary contact arm further includes a groove for accepting said roller, said roller holding said first rotary contact arm in a lock open position.

10. The circuit breaker of claim 1 wherein said rotor includes first and second sides, said first rotary contact arm being disposed between said first and second sides, said first elongated slot being disposed in said first side and a second elongated slot disposed in a central portion of said second side, said first pivot pin further extending within said second elongated slot for pivotally securing said first rotary contact arm between said first and second sides of said first rotor.

11. The circuit breaker of claim 1 further including:

a pair of extension springs, one of said pair of extension springs being disposed along a first side of said rotor and another of said first pair of extension springs being disposed along a second side of said rotor;

a first pin extending from said first side of said rotor to said second side of said rotor;

a second pin extending from said first side of said rotor to said second side of said rotor, said extension springs extending between said first and second pins, wherein said first pin contacts one of a plurality of camming surfaces disposed on said rotary contact arm, and said second pin contacts another of said plurality of camming surfaces disposed on said rotary contact arm, said pair of extension springs providing a spring force for urging said first pin toward said second pin, said spring force acting in a direction intersecting an axis of rotation of said pivot pin.

12. The circuit breaker of claim 11 wherein said first pin includes a first roller disposed thereon and said second pin includes a second roller disposed thereon, said first roller contacting one of said plurality of camming surfaces and said second roller contacting another of said plurality of camming surfaces.

13. The circuit breaker of claim 12 wherein said first and second rollers interact with said plurality camming surfaces to position said first rotary contact arm in a contacts closed position.

14. The circuit breaker of claim 12 wherein said first and second rollers interact with a grooved camming surface disposed on said first rotary contact arm to position said first rotary contact arm in a locked open position.

15. The circuit breaker of claim 12 wherein said first and second rollers interact with said plurality of camming surfaces to position said first rotary contact ann in a blown open position.

16. The circuit breaker of claim 1 wherein said rotor is interconnected with said operating mechanism by means of an elongated pin.

17. The circuit breaker of claim 2 wherein said rotor is interconnected with said operating mechanism by means of an elongated pin.

18. The circuit breaker of claim 3 wherein said rotor is interconnected with said operating mechanism by means of an elongated pin.

19. The circuit breaker of claim 1 further including:

an electrically-insulative case and cover, said first rotor is supported in said case and cover by a trunnion.

20. A circuit breaker rotary contact assembly comprising:

a rotor having a first side, a second side, and a perimeter;

a rotary contact arm disposed between said first and second sides of said rotor, said rotary contact arm having a plurality of camming surfaces disposed thereon and a pivot pin extending from a central portion thereof;

a first pin extending from said first side of said rotor to said second side of said rotor, said first pin contacting one of said plurality of camming surfaces;

a second pin extending from said first side of said rotor to said second side of said rotor said second pin contacting another of said plurality of camming surfaces; and a spring extending from said first pin to said second pin, said spring providing a spring force for urging said first pin toward said second pin, said spring force acting in a direction intersecting an axis of rotation of said pivot pin, said rotor including an elongated slot disposed therein for accepting said pivot pin and pivotally securing said rotary contact arm between said first and second sides of said rotor, said elongated slot extending in said direction for allowing said pivot pin to translate in said direction.

21. The rotary contact assembly of claim 20 wherein said first pin includes a first roller disposed thereon and said second pin includes a second roller disposed thereon, said first roller for contacting one of said plurality of camming surfaces, said second roller for contacting another of said plurality of camming surfaces.

22. The rotary contact assembly of claim 20 wherein said first side of said rotor includes a first pair of opposing slots, one of said first pair of opposing slots accepts a first end of said first pin and the other of said first pair of opposing slots accepts a first end of said second pin; and wherein said second side of said rotor includes a second pair of opposing slots, one of said second pair of opposing slots accepts a second end of said first pin and the other of said second pair of opposing slots accepts a second end of said second pin.

23. The rotary contact assembly of claim 20 wherein said first and second pins interact with said plurality of camming surfaces to position said rotary contact arm in a contacts closed position.

24. The rotary contact assembly of claim 20 wherein said first and second pins interact with said plurality of camming surfaces to position said rotary contact arm in a blown open position.

25. The rotary contact assembly of claim 20 wherein said first and second pins interact with a grooved camming surface disposed on said rotary contact arm to position said rotary contact arm in a locked open position.

26. The rotary contact assembly of claim 20 wherein said rotor includes protrusions extending between said first and second sides of said rotor, said protrusions contacting said rotary contact arm to position said rotary contact arm in an open position.

* * * * *